US012654914B2

(12) United States Patent
Collins et al.

(10) Patent No.: US 12,654,914 B2
(45) Date of Patent: Jun. 16, 2026

(54) OVERCAP FOR A TENNIS BALL CONTAINER

(71) Applicant: Wilson Sporting Goods Co., Chicago, IL (US)

(72) Inventors: Jason B. Collins, Wilmette, IL (US); Christopher W. Ryan, Bartlett, IL (US); Chloe J. Lee, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 18/677,230

(22) Filed: May 29, 2024

(65) Prior Publication Data

US 2025/0368406 A1 Dec. 4, 2025

(51) Int. Cl.

| | |
|---|---|
| ***B65D 51/20*** | (2006.01) |
| ***A63B 47/00*** | (2006.01) |
| ***B65D 1/16*** | (2006.01) |
| ***B65D 81/20*** | (2006.01) |
| *A63B 102/02* | (2015.01) |

(52) U.S. Cl.

CPC ..... *B65D 51/20* (2013.01); *A63B 47/00* (2013.01); *B65D 1/165* (2013.01); *B65D 81/2053* (2013.01); *A63B 2102/02* (2015.10); *B65D 2251/0018* (2013.01); *B65D 2251/0093* (2013.01)

(58) Field of Classification Search

CPC ..... B65D 51/20; B65D 1/165; B65D 51/22; B65D 2543/00092; A63B 47/00; A63B 2102/02

USPC ..... 206/315.9; 220/270

See application file for complete search history.

(56) References Cited

U.S. PATENT DOCUMENTS

| | | | | |
|---|---|---|---|---|
| 1,214,675 | A * | 2/1917 | Heath | B65D 41/485 413/66 |
| 1,778,225 | A | 10/1930 | Morss | |
| 3,421,648 | A | 1/1969 | Giessler | |
| 3,899,096 | A | 8/1975 | Marco | |
| 4,678,108 | A | 7/1987 | Inman | |
| 4,773,557 | A | 9/1988 | Ohta | |
| 4,798,319 | A | 1/1989 | James, Jr. | |
| D311,140 | S | 10/1990 | Nelson | |
| 5,016,750 | A * | 5/1991 | Gordon | B65D 71/504 206/824 |
| D321,325 | S | 11/1991 | Petrus | |
| D327,604 | S | 7/1992 | Culverson | |

(Continued)

*Primary Examiner* — Steven A. Reynolds

(74) *Attorney, Agent, or Firm* — Terence P. O'Brien; Todd A. Rathe

(57) ABSTRACT

A tennis ball container for storing at least one tennis ball. The container extends along a longitudinal axis and has an open end. The container includes a removable seal enclosing the open end, and an annular overcap. The seal includes a pull tab. The overcap includes a body adapted for removably attachment to the open end of the tennis ball container. The body includes a peripheral rim for engaging an outer surface of the container at the open end, and a lip projecting from the peripheral rim toward the longitudinal axis. The lip extends over a portion of the removable seal and over a portion of the pull tab. The lip defines a first opening. The lip is configured to inhibit the at least one tennis ball from passing through the first opening. The annular overcap defines at least one breakaway region for facilitating breaking of the annular overcap.

20 Claims, 16 Drawing Sheets

(56) References Cited

U.S. PATENT DOCUMENTS

D327,845 S 7/1992 Behm et al.
5,129,531 A * 7/1992 Beck ..... B65D 41/48 220/276
D338,621 S 8/1993 Balson
5,292,161 A 3/1994 Green
D346,433 S 4/1994 Cooper
D355,708 S 2/1995 Caine
D384,550 S 10/1997 Dernoga
D387,662 S 12/1997 Bright et al.
5,833,091 A 11/1998 Palmer
5,848,690 A 12/1998 Granger et al.
D424,205 S 5/2000 Williams
6,082,567 A * 7/2000 Bietzer ..... B65D 41/485 215/354
6,196,408 B1 * 3/2001 Setty ..... B65D 3/261 220/276
D489,611 S 5/2004 Monsanty
D555,473 S 11/2007 Lilly et al.
D586,434 S 2/2009 Brockington
7,591,369 B2 9/2009 Lin et al.
D604,614 S 11/2009 Janboecke
D623,061 S 9/2010 Wong
7,922,608 B1 4/2011 Shoham
D681,176 S 4/2013 Chacko
8,407,854 B2 * 4/2013 Tsai ..... B60B 33/0089 16/45
D717,469 S 11/2014 Nemeth
9,068,682 B2 * 6/2015 Zeyfang ..... F16L 57/005
D803,917 S 11/2017 Harada
D804,556 S 12/2017 Harada
D827,592 S 9/2018 Inchino
D833,581 S 11/2018 Atwell
D837,054 S 1/2019 Mallahan, III
D840,364 S 2/2019 Inchino
D854,736 S 7/2019 Moore
D870,314 S 12/2019 Okuda
D871,609 S 12/2019 Isozaki
D873,139 S 1/2020 Chapin
D873,387 S 1/2020 Vogtner
D875,525 S 2/2020 Griffs
D896,675 S 9/2020 DiMartini
D918,039 S 5/2021 Ozturk
D952,464 S 5/2022 Collins
11,634,254 B2 * 4/2023 Tidwell ..... B65D 17/02 220/266
12,325,565 B2 * 6/2025 Barrette ..... B65D 50/00
2004/0105917 A1 * 6/2004 Mannion ..... B65D 81/3869 426/110
2019/0016508 A1 1/2019 Campbell
2020/0070010 A1 3/2020 Dillion et al.
2020/0360769 A1 11/2020 Patel
2021/0237942 A1 * 8/2021 Collins ..... B65D 41/10
2022/0009677 A1 1/2022 Collins

* cited by examiner

PRIOR ART

FIG. 18
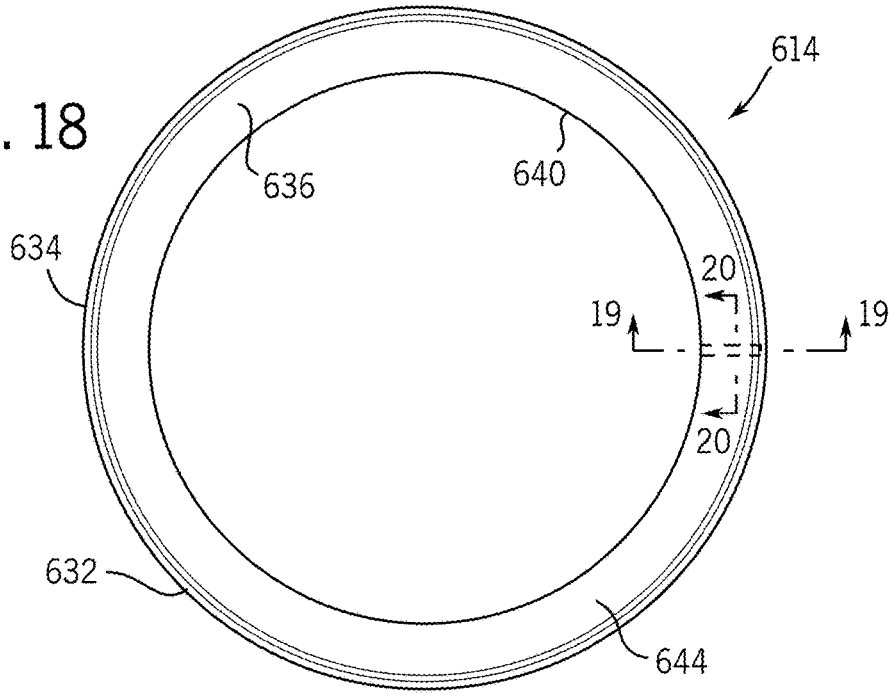
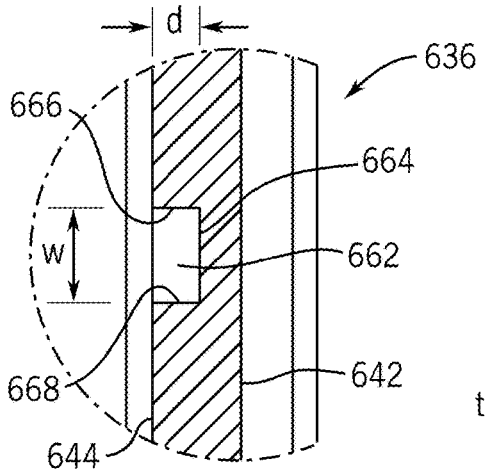
FIG. 20
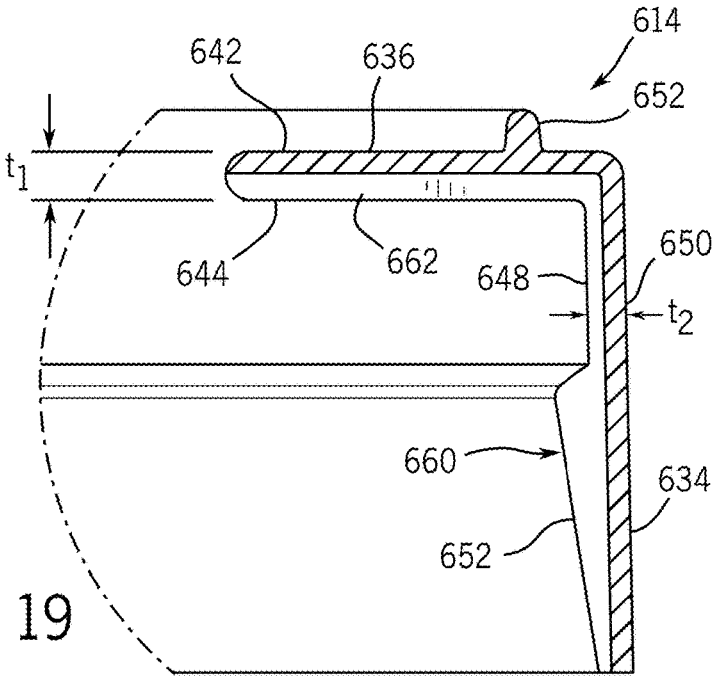
FIG. 19

OVERCAP FOR A TENNIS BALL CONTAINER

FIELD OF THE INVENTION

The present invention relates generally to an improved overcap for a tennis ball container.

BACKGROUND OF THE INVENTION

Tennis balls are typically stored in a pressurized cylindrical body having a closed end and a second end that is sealed with a removable seal. Once the seal is removed, pressure is lost from the body and the second end becomes an open end. An overcap is commonly provided with most pressurized tennis ball containers to allow for the tennis balls to be placed into the cylindrical body through the open end, and then for the second end to be closed.

Existing overcaps are thick solid pieces of plastic that extend and fully cover the open end of the tennis ball container. The overcaps can add undesirable weight and cost to the tennis ball container. Accordingly, there is a continuing need for an improved overcap that can address these undesirable aspects of existing overcaps.

SUMMARY OF THE INVENTION

The present invention provides a tennis ball container for storing at least one tennis ball. Each of the at least one tennis balls has a maximum cross-sectional area and a diameter. The container comprises a cylindrical body extending along a longitudinal axis and having a first closed end and a second open end opposite the first closed end, a removable seal enclosing the second open end and including a pull tab, and an annular overcap. The annular overcap removably attaches to the second end of the cylindrical body. The annular overcap includes a peripheral rim for engaging an outer surface of the container at the open end, and a lip projecting from the peripheral rim toward the longitudinal axis. The peripheral lip extends over a portion of the second open end. The lip extends over a portion of the removable seal and over a portion of the pull tab. The lip defines a first opening and is configured to inhibit the at least one tennis ball from passing through the first opening. The annular overcap defines at least one breakaway region for facilitating breaking of the annular overcap.

This invention will become more fully understood from the following detailed description, taken in conjunction with the accompanying drawings described herein below, and wherein like reference numerals refer to like parts.

BRIEF DESCRIPTION OF THE DRAWINGS

FIG. 18 is bottom view of the overcap of FIG. 16.

FIG. 19 is a cross-sectional view of the overcap taken along line 19-19 of FIG. 18.

FIG. 20 is an enlarged view of the overcap taken along line 20-20 of FIG. 18.

DETAILED DESCRIPTION OF THE PREFERRED EMBODIMENTS

Figure 1:
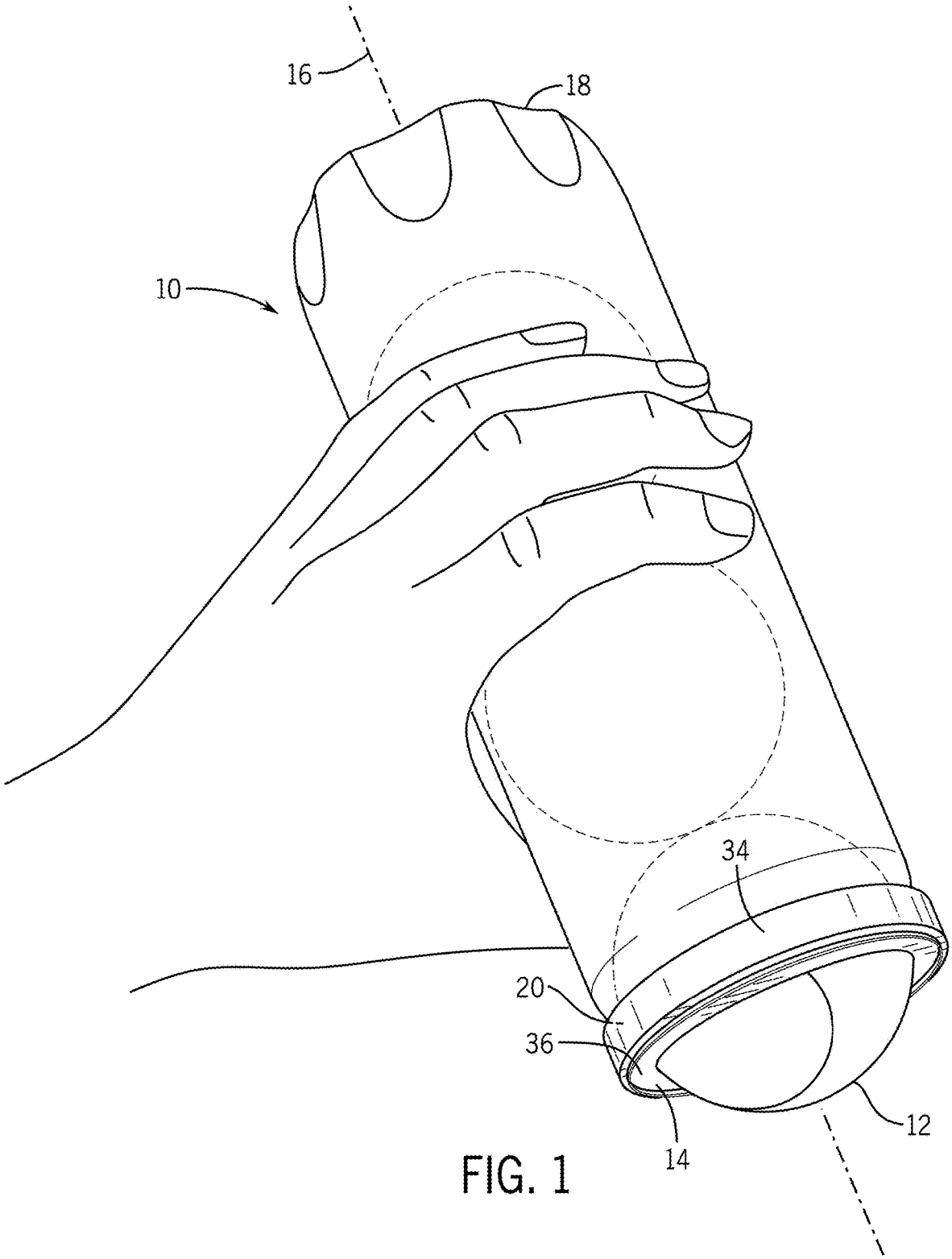
FIG. 1 is a side perspective view of a container for tennis balls including an improved overcap in accordance with an implementation of the present invention.
Figure 2:
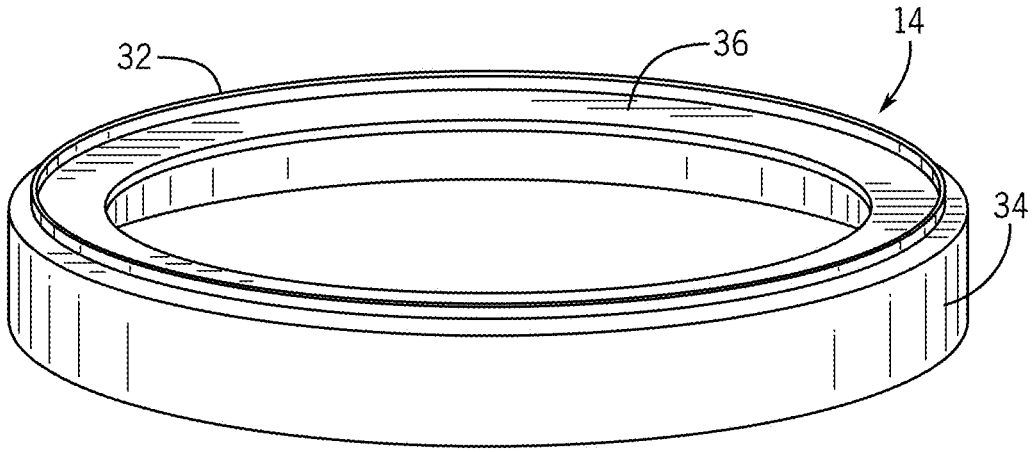
FIG. 2 is a top, side perspective view of the overcap of FIG. 1.
Figure 3:
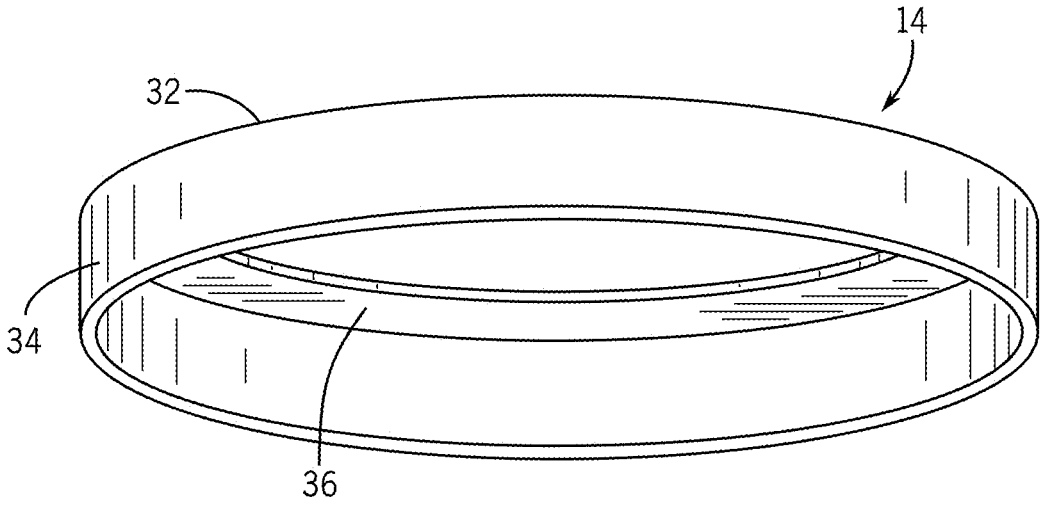
FIG. 3 is a bottom, side perspective view of the overcap of FIG. 1.

Referring to FIG. 1, a container 10 holding a plurality of tennis balls 12 is shown with an improved overcap 14. The container 10 is sized to hold two, three, four or more tennis balls 14. In one implementation, the container 10 is a cylindrical container extending about a longitudinal axis 16. The container includes a first closed end 18 and a second end 20 opposite the closed end 18. The container can have a circular cross-sectional shape when viewed about a plane extending through the container 10 and perpendicular to the longitudinal axis 16. In other implementations, the container can take other shapes, such as, for example, a shape having a polygonal cross-sectional area.

Figure 6:
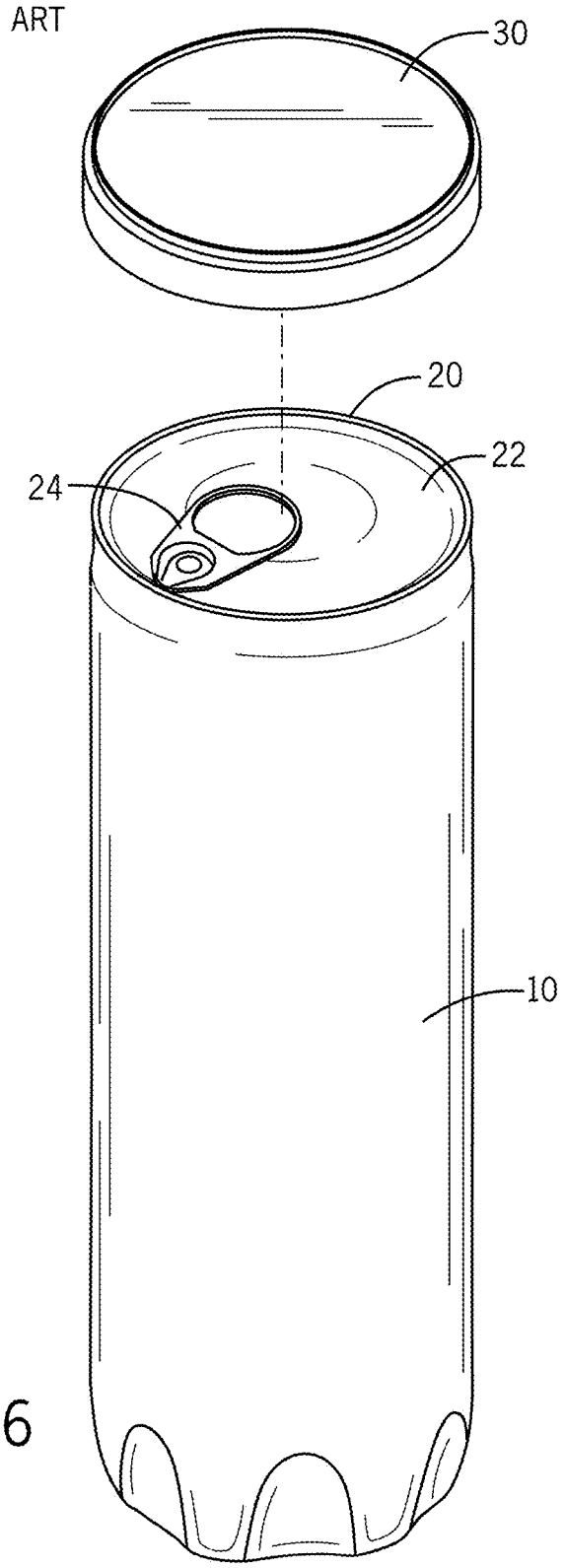
FIG. 6 is top perspective view of a tennis ball container and a conventional tennis ball container overcap shown above the container.

Referring to FIG. 6, the container 10 is typically pressurized to retain the tennis balls 12 in a pressurized state. Tennis balls 12 are typically sold new in a pressurized state in which the balls are pressurized within a range of 5 to 15 psi. In one example, premium tennis balls are pressurized to approximately 13 psi. In order to maintain the tennis balls 12 in a pressurized state, the tennis ball container 10 is typically also pressurized within the range of 5 to 15 psi. The container 10 is typically initially configured and sold with a removable seal 22 positioned over at the second end 20, closing the second end 20 to maintain the container 10 in a pressurized state. The removable seal 22 is typically formed of an aluminum alloy or similar material and includes a pop-top tab 24 to facilitate the removal of the seal 22 from the second end 20 of the container 10. Once the seal 22 is removed from the second end 20, the seal 22 is typically discarded leaving the second end 20 open.

Existing tennis ball containers are typically sold with a prior art overcap 30, which is a circular lid formed of a continuous piece of polymeric material, such as a thick plastic. The overcap is used, after the seal 22 has been removed from the second end 20, to store the tennis balls 12 and retain them in the container for later use. Existing overcaps 30 add to the cost, weight and waste associated with a tennis ball container. Accordingly, there is a continuing need to provide an improved overcap that can be produced at a lower cost, have a lighter weight, and result in less waste associated with the tennis ball container.

Referring to FIGS. 1-4A and 5, an improved tennis ball container overcap 14 is illustrated. The overcap 14 includes a body 32 adapted for removable attachment to the open end 20 of the container 10. The body 32 is formed of a lightweight, resilient material, such as a plastic. In other implementations, the body 32 can be formed of other materials, such as, for example, other polymeric materials, a rubber, a wood, an aluminum, other alloys, or combinations thereof. The body 32 of the overcap 14 includes a peripheral rim 34 for engaging an outer surface of the container 10 at the open second end 20. The peripheral rim 34 extends around the entire circumference or periphery of the container 10 at the second end 20. The body 32 further includes a lip 36 radially projecting from at least one location on the peripheral rim 34 toward the longitudinal axis 16. In the implementation of FIGS. 1-5, the lip 36 uniformly projects radially toward the longitudinal axis 16 about the entire periphery or circumference of the rim 34. The lip 36 and/or the peripheral rim 34 define a first overcap opening 40. The first overcap opening 40 is circular and is sized so as to smaller than the diameter of the tennis ball 12 and/or smaller than that maximum cross-sectional area of the tennis ball 12. The diameter of a typical tennis ball is within the range of 2.57 to 2.7 inches. Accordingly, the overcap opening 40 of the implementation of FIGS. 1-4*a* and 5 has a diameter less than 2.57 inches. The maximum cross-sectional area of a typical tennis ball would be $\pi r^2$, or $\pi(1.285\text{ in})^2$ to $\pi(1.35\text{ in})^2$ or $5.187\text{ in}^2$ to $5.725\text{ in}^2$. In other implementations, the size of the diameter or the maximum cross-sectional area can be a different dimension or area.

As illustrated in FIG. 1, the first overcap opening 40 of the overcap 14 is sized to retain the tennis balls 14 within the container 10. In the implementation, of FIG. 1, the first opening 40 may allow for a portion of the tennis ball 12 closest to the second end 20 of the container 10 to slightly extend through the first opening 40.

The first opening 40 is sufficiently large enough that the amount of material used to produce the improved overcap 14 is at least 40 percent lower than the amount of material used to produce a conventional overcap. In another implementation, the opening 40 is sufficiently large enough that the amount of material used to produce the improved overcap 14 is at least 50 percent lower than the amount of material used to produce a conventional overcap 30. A conventional tennis container overcap can weigh approximately 6.1 grams, and in one implementation, the overcap 14 weighs 3.5 grams, which is a reduction in weight of over 42 percent. Accordingly, the weight of the overcap 14 was measured to be more than 40 percent lower than the weight of a conventional tennis can overcap. Accordingly, the improved overcap 14 results in significantly lower waste, significantly lower material cost, and significantly lower weight than a conventional overcap 30. Less material results in less material for recycling and/or landfills.

Figure 4A:
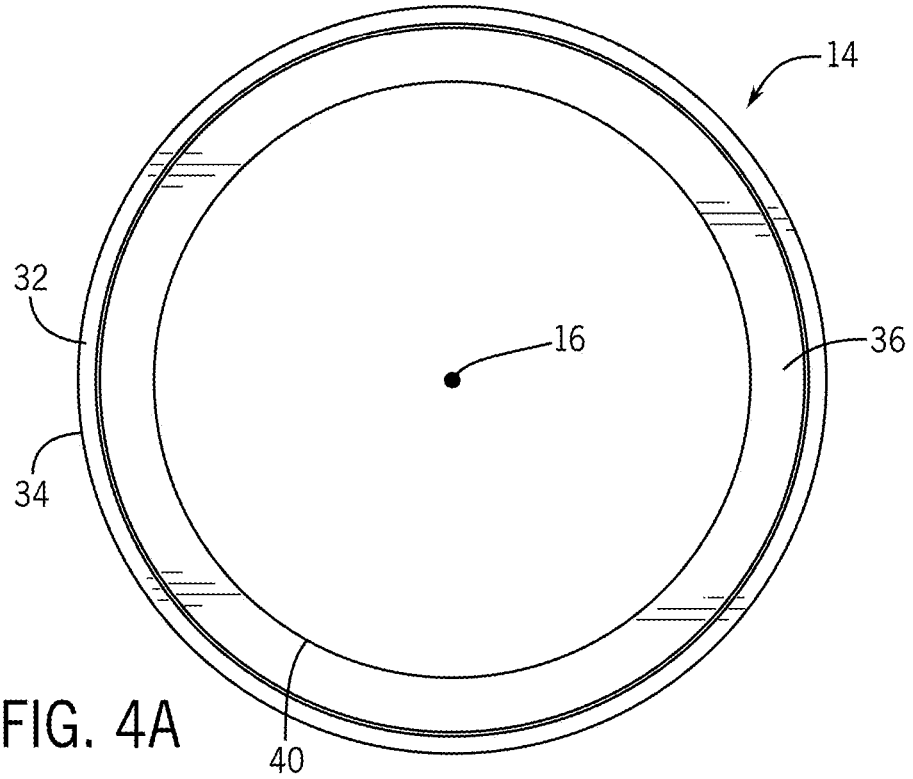
FIG. 4A is a top view of the overcap of FIG. 1.
Figure 4B:
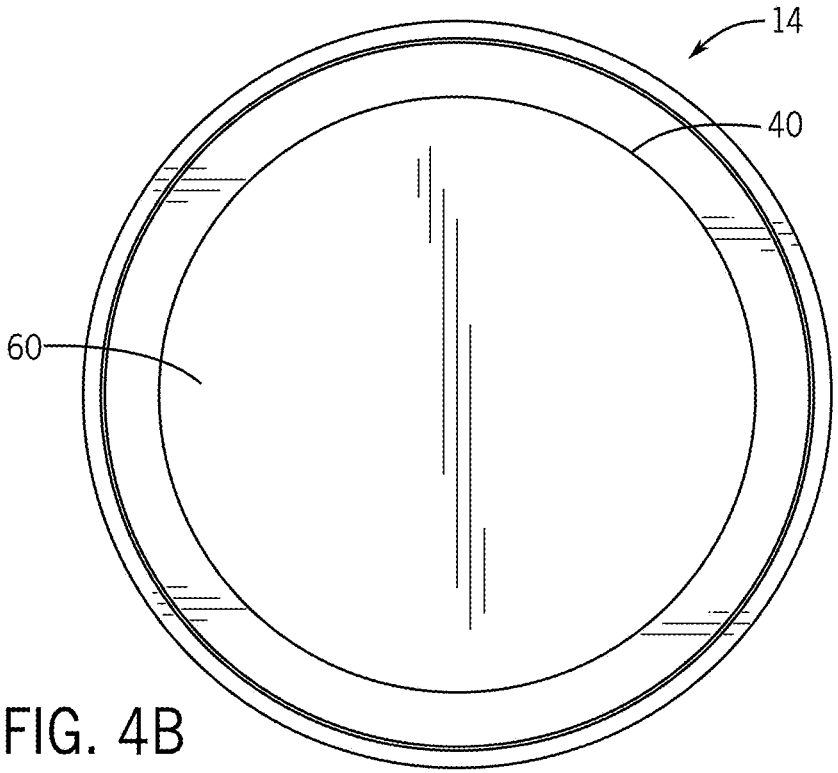
FIG. 4B is a top view of an overcap for a tennis ball container in accordance with another implementation of the present invention.
Figure 5:
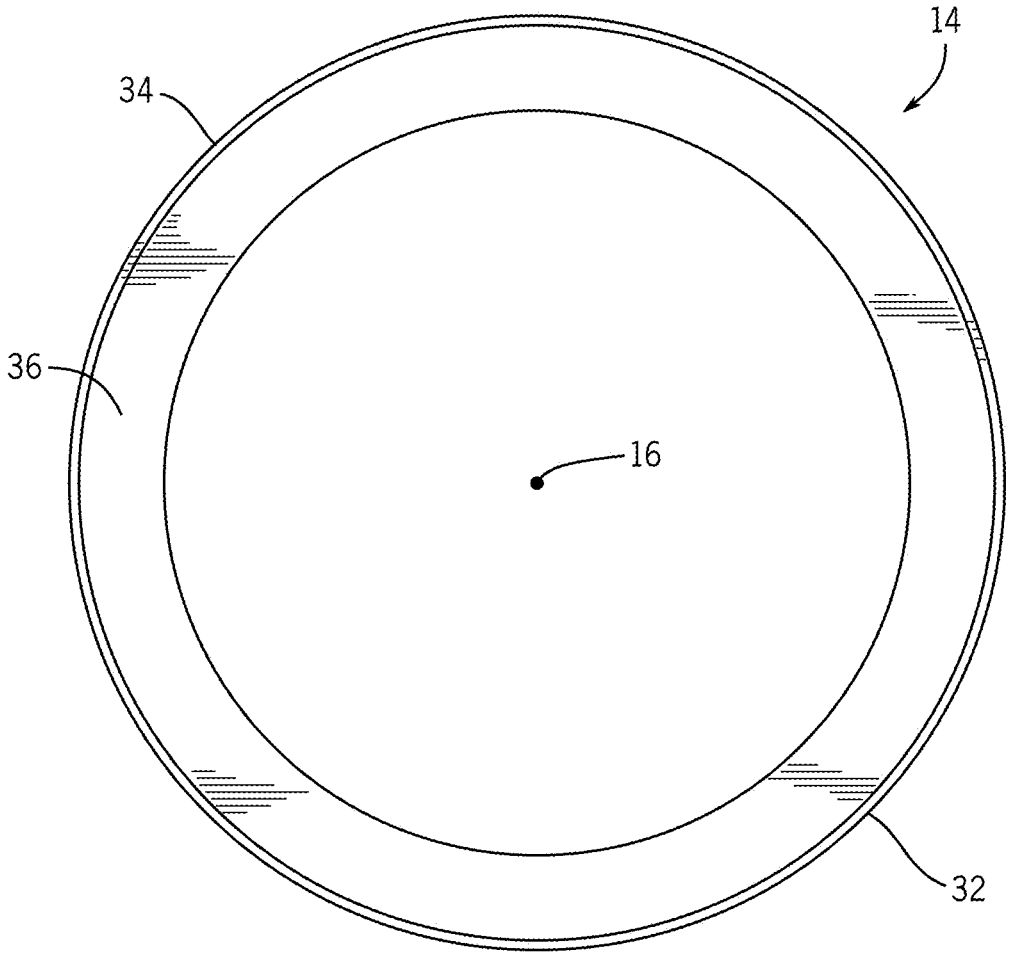
FIG. 5 is a bottom view of the overcap of FIG. 1.

Referring to FIG. 4B, in one implementation, a very thin layer 60 of lightweight material can be applied over the opening 40 of the overcap 14. The very thin layer 60 of lightweight material can be used to prevent dirt, debris or moisture from entering the tennis ball container 10 with the overcap 14 applied to the second end 20 of the container 10 after the pop-top tab 24 is removed from the container 10.

Figure 7:
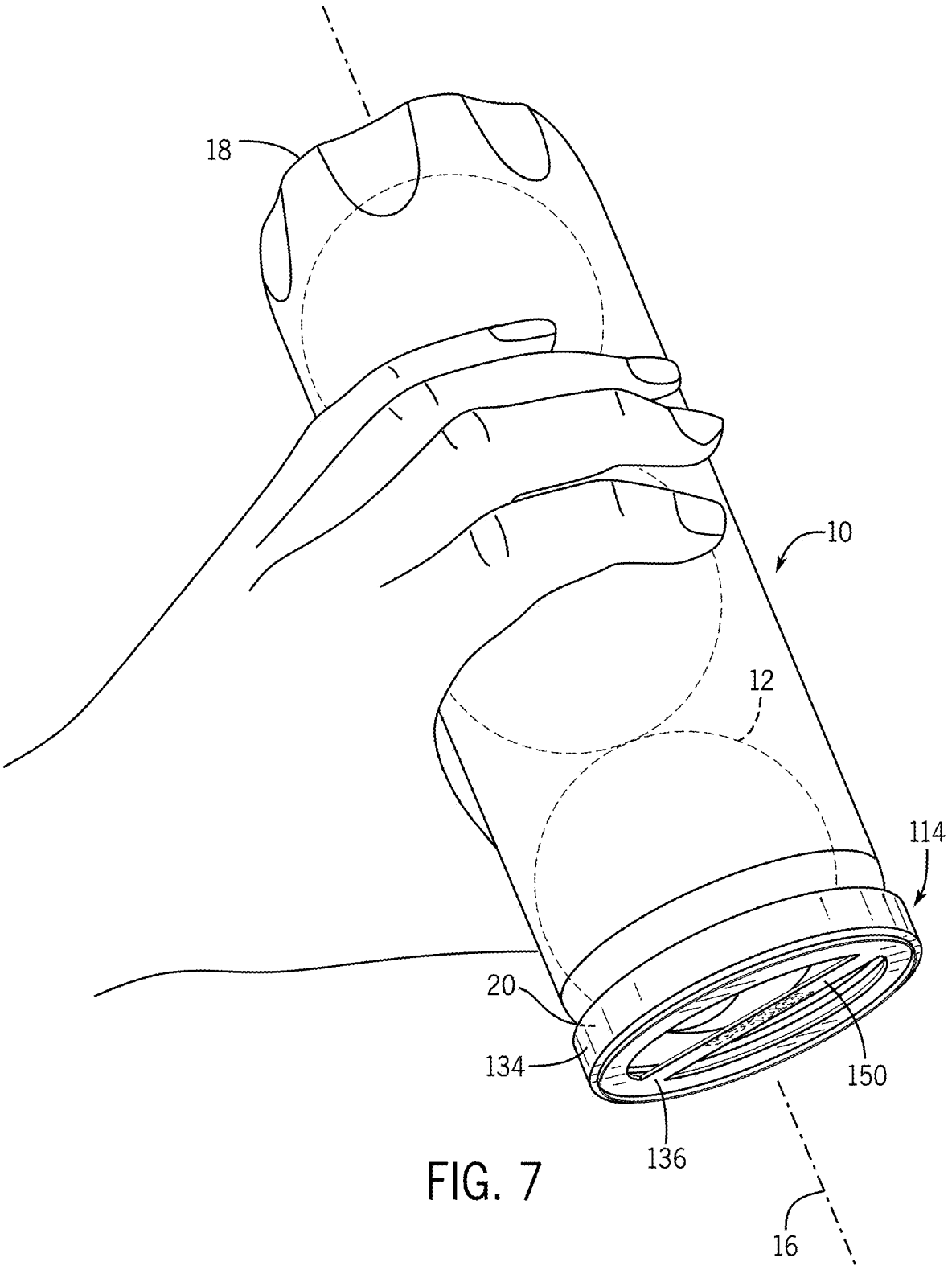
FIG. 7 is a side perspective view of a container for tennis balls including an improved overcap in accordance with another implementation of the present invention.
Figure 8:
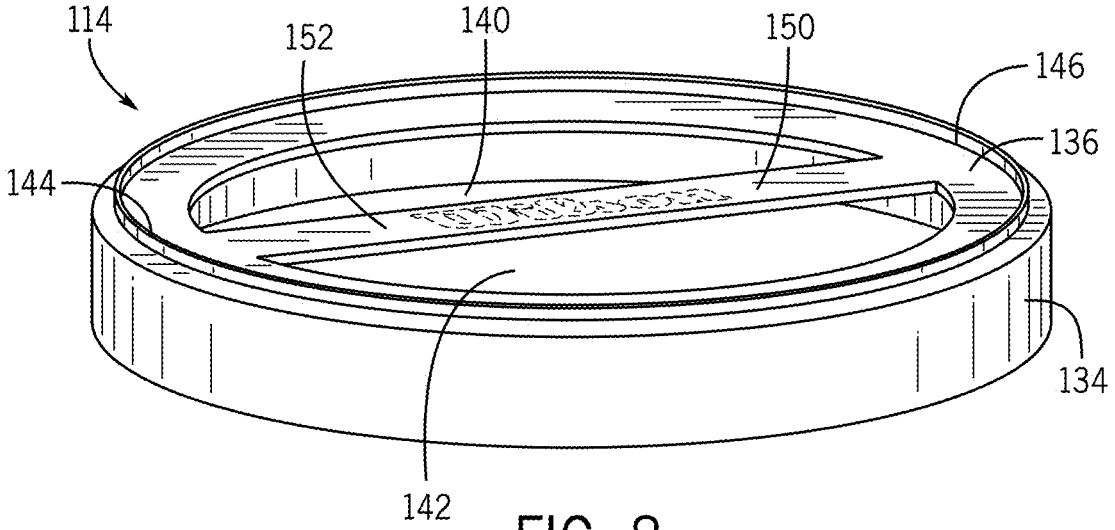
FIG. 8 is a top, side perspective view of the overcap of FIG. 7.
Figure 9:
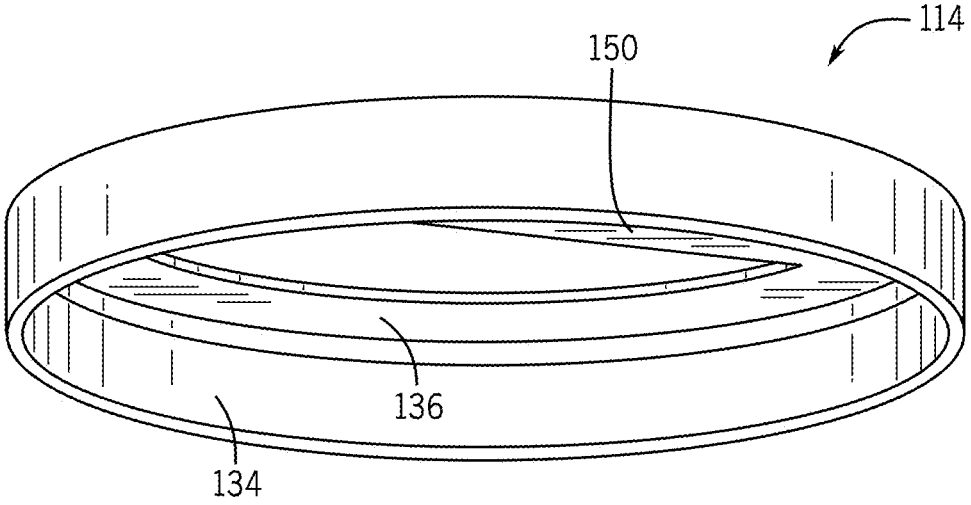
FIG. 9 is a bottom, side perspective view of the overcap of FIG. 7.
Figure 10:
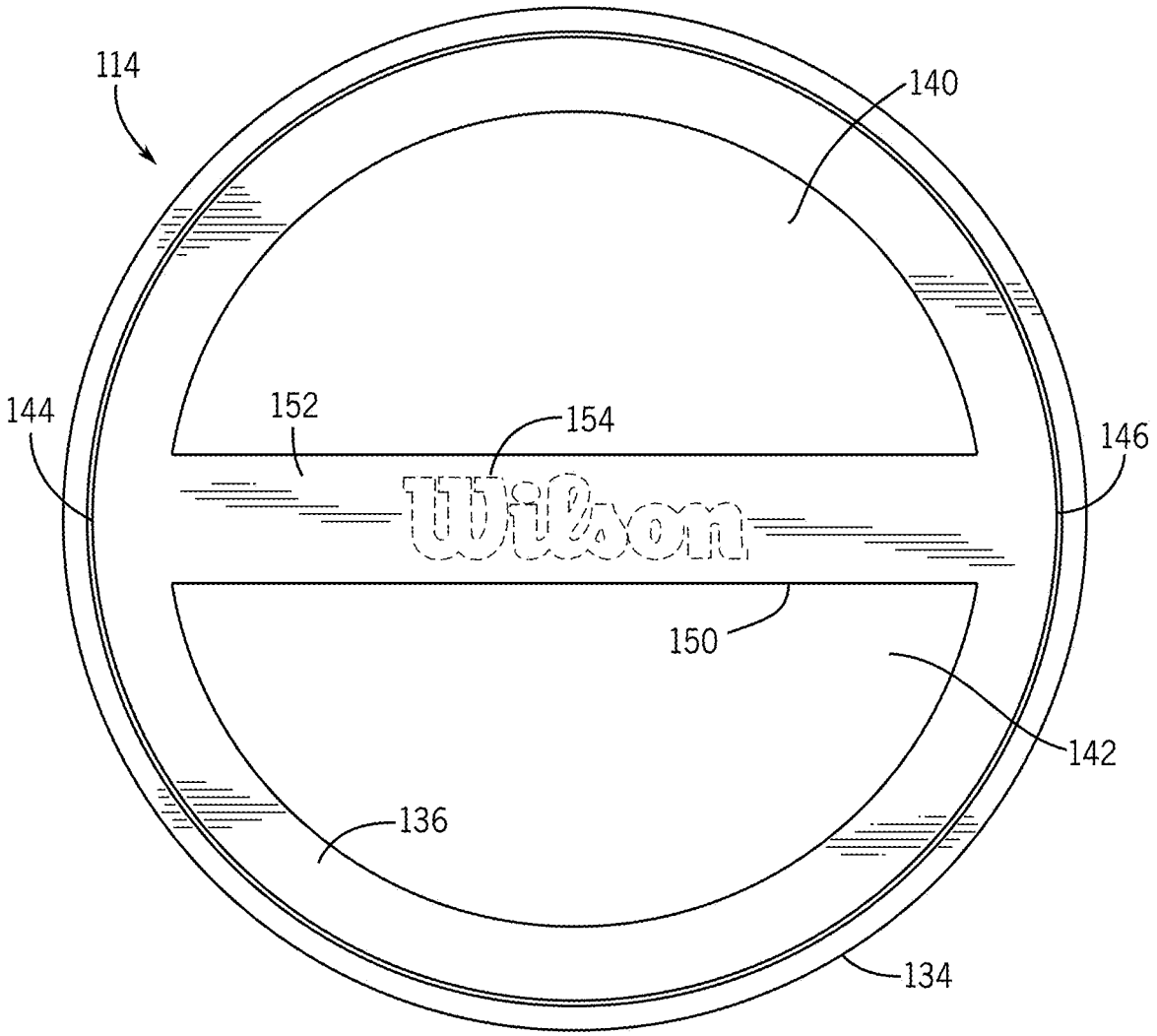
FIG. 10 is a top view of the overcap of FIG. 7.
Figure 11:
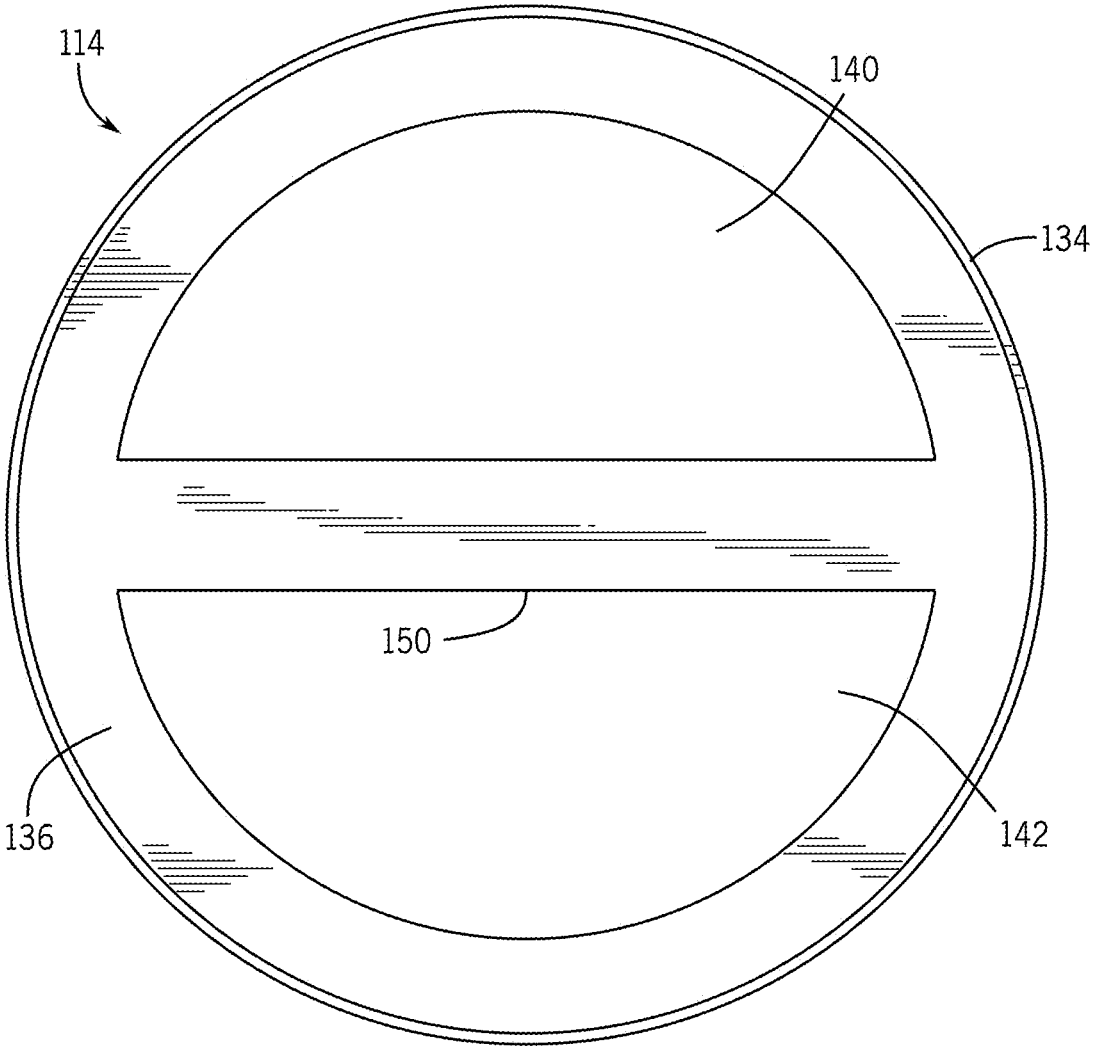
FIG. 11 is a bottom view of the overcap of FIG. 7.

Referring to FIGS. 7 through 11, another implementation of a tennis ball container overcap 114 is illustrated. The tennis ball container overcap 114 is substantially similar to the overcap 14 except that the overcap 114 includes a lip 136 that extends from a first location 144 of a peripheral rim 134 to a second location 146 about the peripheral rim 134 to form a band 150. The band 150, the peripheral rim 134 and/or the lip 136 define first and second overcap openings 140 and 142. The band 150 includes an outer surface 152, and the outer surface 152 can include alphanumeric and/or graphical indicia 154, such as, a trademark, a symbol, an instruction, a descriptive or inspirational message and/or combinations thereof. As shown in FIG. 7, the band 150 retains the tennis balls 12 within the container 10, such that no portion of the tennis ball 12 closest to the second end 20 projects or extends through the first or second overcap openings 140 and 142. The overcap 114 includes the same or similar benefits of the overcap 14 by requiring less material to produce, resulting in less cost and less waste.

Figure 12:
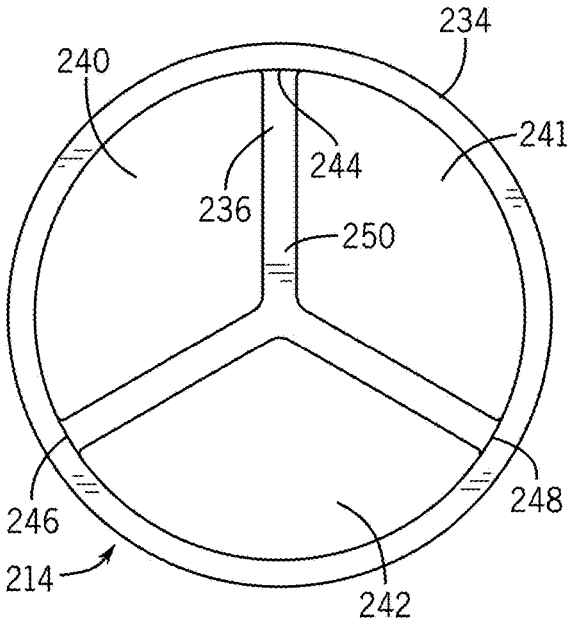
FIGS. 12 through 15 are top views of overcaps for tennis ball containers in accordance with other alternative implementations of the present invention.

FIGS. 12 through 15 illustrate other implementations of an improved overcap. Referring to FIG. 12, an improved overcap 214 is illustrated. Overcap 214 is substantially similar to overcap 14 and overcap 114 except that overcap 214 includes a lip 236 including a band 250 that extends from a first location 244 of a peripheral rim 234 to second and third spaced-apart locations 246 and 248 about the peripheral rim 234, such that the band 250, the peripheral rim 234 and/or the lip 236 define first, second and third overcap openings 240, 242 and 241, respectively. Similar to the band 150, the band 250 retains the tennis balls 12 within the container 10, such that no portion of the tennis ball 12 closest to the second end 20 projects or extends through the first, second or third overcap openings 240, 242 and 241. The overcap 214 includes the same or similar benefits of the overcap 14 by requiring less material to produce, resulting in less cost and less waste.

Figure 13:
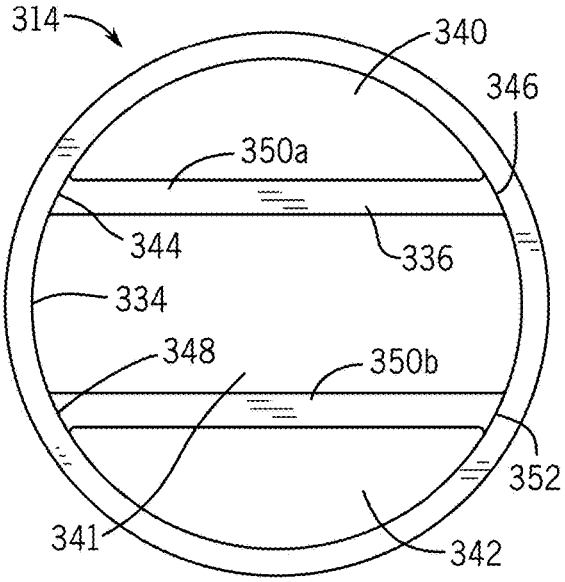

Referring to FIG. 13, an improved overcap 314 is illustrated. Overcap 314 is substantially similar to overcap 14, overcap 114 and overcap 214 except that overcap 314 includes a lip 336 including a pair of bands 350*a* and 350*b* that extend from a first location 344 to a second location 346 about a peripheral rim 334, and from a third location 348 to a fourth location 352 about the peripheral rim 334, respectively. The band 350, the peripheral rim 334 and/or a lip 336 define first, second and third overcap openings 340, 342 and 341, respectively. Similar to the band 150, the band 350 retains the tennis balls 12 within the container 10, such that no portion of the tennis ball 12 closest to the second end 20 projects or extends through the first, second or third overcap openings 340, 342 and 341. The overcap 314 includes the same or similar benefits of the overcap 14 by requiring less material to produce, resulting in less cost and less waste.

Figure 14:
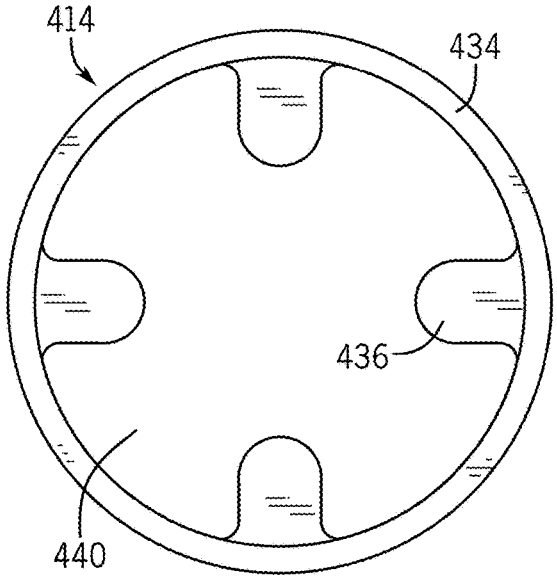

Referring to FIG. 14, an improved overcap 414 is illustrated. Overcap 414 is substantially similar to overcap 14, overcap 114, overcap 214 and overcap 314 except that overcap 314 includes a set of four lips 436 that radially project toward the longitudinal axis 16 from four spaced-apart locations of a peripheral rim 434. The four spaced-apart locations can include first, second, third and fourth locations that are equally angularly spaced apart about the peripheral rim 434. In other implementations, other numbers of lips 436 can be used including 1, 2, 3, 5 or more lips, and the lips can be positioned in other locations or arrangements about the peripheral rim 434. The peripheral rim 434 and the lips 436 define an overcap openings 440. Similar to overcap 14 and the first opening 40, the lips 436 can be sized so as to retain the tennis balls 12 within the container 10 and allow a small portion of the tennis ball 12 closest to the second opening 20 of the container to extend or project through the opening 440. The overcap 414 includes the same or similar benefits of the overcap 14 by requiring less material to produce, resulting in less cost and less waste.

Figure 15:
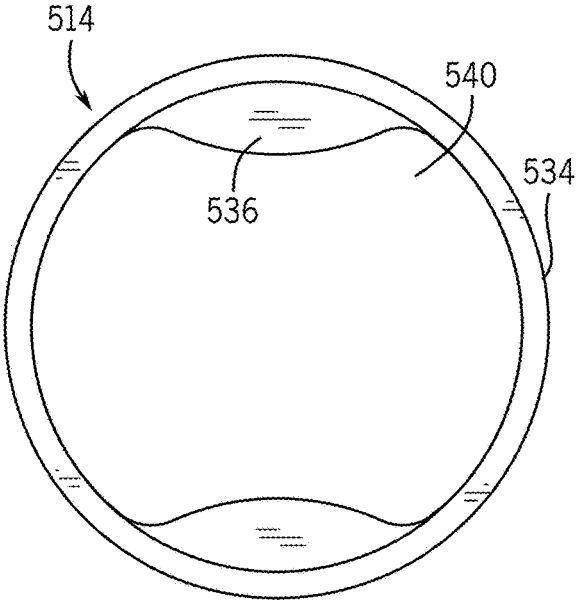
Figure 16:
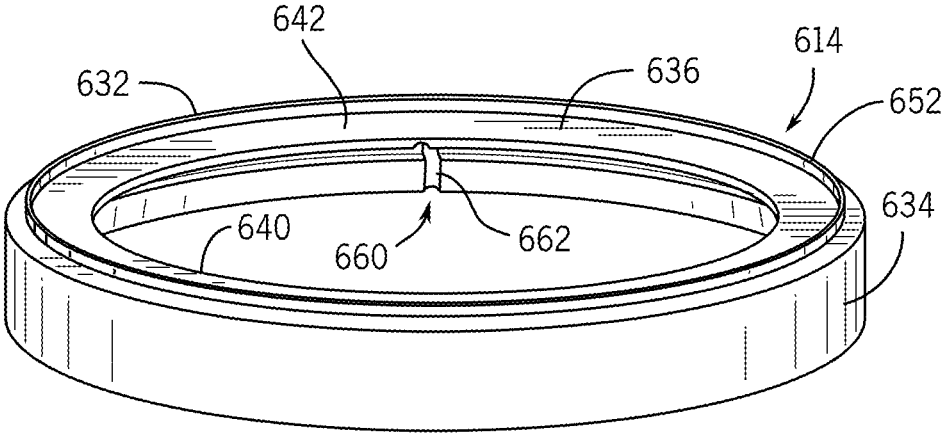
FIG. 16 is a top, side perspective view of an overcap in accordance with another implementation of the present invention.
Figure 17:
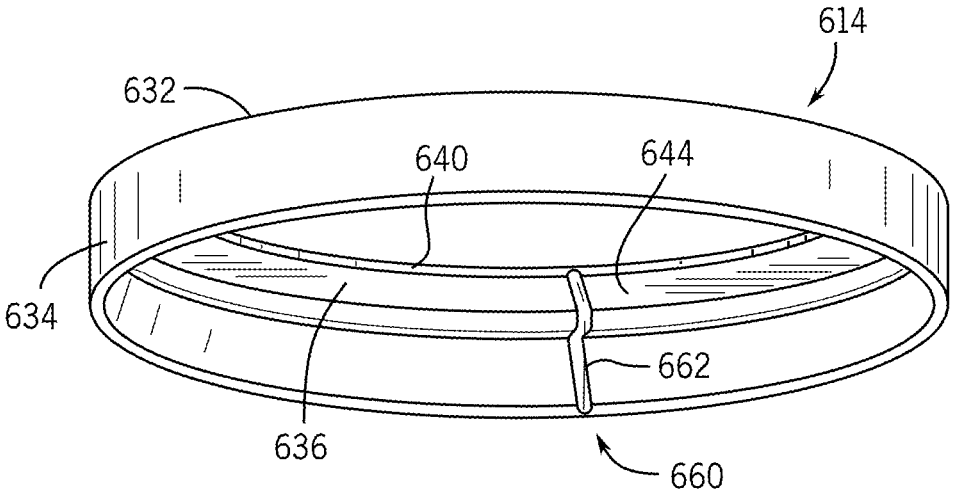
FIG. 17 is a bottom, side perspective view of the overcap of FIG. 16.

Referring to FIG. 15, an improved overcap 514 is illustrated. Overcap 514 is substantially similar to overcap 14, overcap 114, overcap 214, overcap 314 and overcap 415 except that overcap 514 includes a pair of lips 536 that radially project toward the longitudinal axis 16 from two angularly spaced-apart locations of a peripheral rim 534. The two spaced-apart locations can include first and second locations that are equally angularly spaced apart about the peripheral rim 534. In other implementations, other numbers of lips 536 can be used including 1, 3, 4 or more lips, and the lips 536 can be positioned in other locations or arrangements about the peripheral rim 534. The peripheral rim 534 and the lips 536 define an overcap opening 540. Similar to overcap 14 and the first opening 40, the lips 536 can be sized so as to retain the tennis balls 12 within the container 10 and allow a small portion of the tennis ball 12 closest to the second opening 20 of the container to extend or project through the opening 540. The overcap 514 includes the same or similar benefits of the overcap 14 by requiring less material to produce, resulting in less cost and less waste.

FIGS. 16 through 21 illustrate another implementation of the present invention. Overcap 614 is substantially similar to overcap 14 except that overcap 614 includes a breakaway region 660. The overcap 614 includes a body 632 adapted for removable attachment to the second end 20 of the container 10. The body 632 of the overcap 614 includes a peripheral rim 634 for engaging an outer surface of the container 10 at the open second end 20. The peripheral rim 634 extends around the entire circumference or periphery of the container 10 at the second end 20. The body 632 further includes a lip 636 radially projecting from at least one location on the peripheral rim 634 toward the longitudinal axis 16. The lip 636 defines a first overcap opening 640. The first overcap opening 640 is circular and is sized so as to smaller than the diameter of the tennis ball 12 and/or smaller than that maximum cross-sectional area of the tennis ball 12.

The lip 636 has an upper surface 642 and a lower surface 644, and the peripheral rim 634 has an upper surface 646, and inner surface 648 and an outer surface 650. In one implementation, the upper surface 642 of the lip 636 is coplanar with the upper surface 646 of the peripheral rim 634. An annular projection 652 extends from upper surface of the lip 636. The annular projection 652 facilitates grasping of the overcap 614 when removing the overcap 614 from the second end 20 of the container 10.

In some implementations, the peripheral rim 634 can have variable thickness between the inner surface 648 and the outer surface 650. Referring to FIG. 19, the variable thickness of the peripheral rim 634 can form a bulge 652 or a ridge that extends radially inward and helps to secure the overcap 640 to the open end 20 of the container 10.

Figure 21:
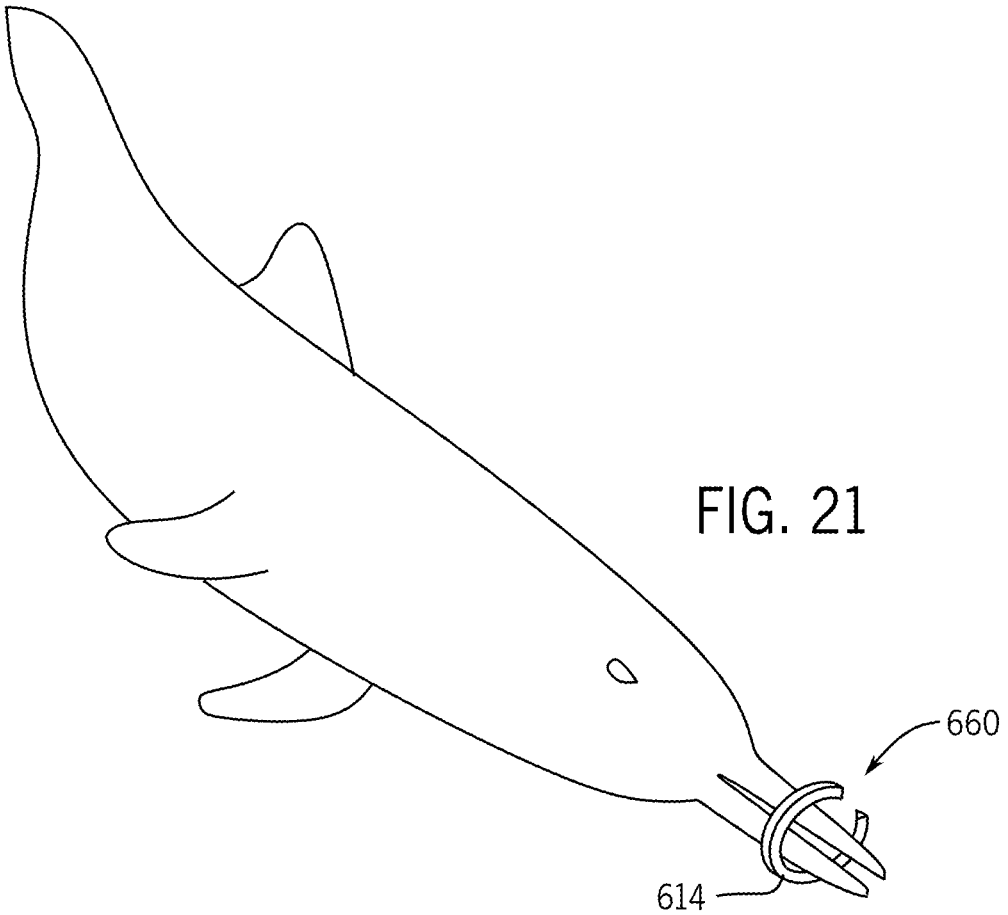
FIG. 21 is a perspective view of the overcap breaking or rupturing about the beak of a dolphin.

The overcap 614 includes at least one breakaway region 660. The breakaway region 660 is configured to allow the overcap 614 to be readily removed from the second end 20 of the container 10 and reattached to the second end 20 of the container 10 when desired by the user. In other words, the breakaway region 660 is configured to remain intact and unbroken during normal use, which can include repeated or many removals of the overcap 614 from the second end and numerous reattachments of the overcap 614 to the second end 20. Importantly, the breakaway region 660 is configured to break, tear or rupture if a tensile load of at least 7.5 pounds of kilograms force (kgf) is applied to the breakaway region 660 under a tensile load test as described below. Accordingly, the overcap 614 with the breakaway region 660 is configured to remain intact and unseparated during normal, repeated use. However, if the overcap 614 is discarded and ends up on a nose, beak, mouth or snout of an animal, the overcap 614 is designed to rupture if the animal opens its beak, mouth or snout thereby minimizing the risk of injury or harm to such an animal or wildlife. FIG. 21 illustrates one example of the breakaway region 660 of the overcap 614 rupturing in response to the opening of the beak or rostrum of a dolphin.

In one implementation, the breakaway region 660 can be formed by the lip 636 defining a recess 662. The recess 662 can be radially extending from the longitudinal axis 16 of the container 10. In other implementations, the recess 662 can extend in other directions along or about the lip 636, such as angled with respect to a radial direction or curved, or spiraled. The lip 636 has a lip thickness $t_1$ measured between the upper surface 642 and the lower surface 644. In one implementation, the recess 662 has a depth d that is within the range of 30 to 70 percent of the lip thickness $t_1$. In other implementations, the recess 662 can have a depth d within the range of 45 to 55 percent of the lip thickness $t_1$.

In other implementations, the lip 636 and the peripheral rim 634 can define the recess 662. In one implementation, the recess 662 can extend radially about the lip 636 and into the peripheral rim 634 and then extend longitudinally about a portion or all of the length or height of the peripheral rim 634. The peripheral rim 634 can have a minimum rim thickness $t_2$ measured between the inner surface 648 and the outer surface 650. In one implementation, the recess 662 has a depth that is within the range of 30 to 70 percent of the minimum rim thickness $t_2$. In other implementations, the recess 662 can have a depth d within the range of 45 to 55 percent of the minimum rim thickness $t_2$. In one implementation, the minimum rim thickness $t_2$. is 0.4 mm.

Figure 22A:
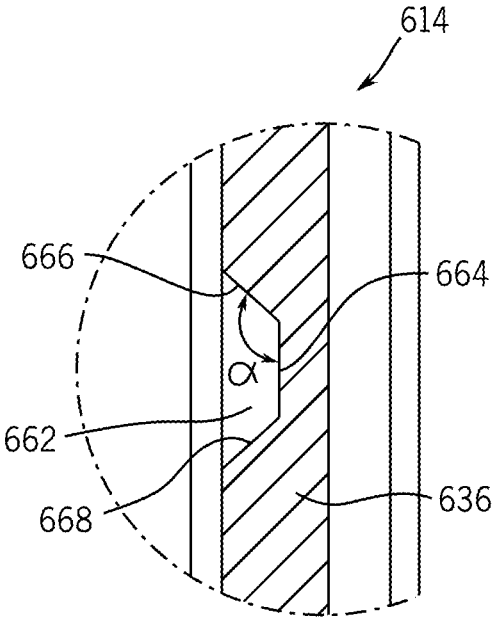
FIGS. 22A and 22B are enlarged views of the overcap taken along line 20-20 of FIG. 18 showing other implementations of a recess formed within a lip of the overcap.
Figure 22B:
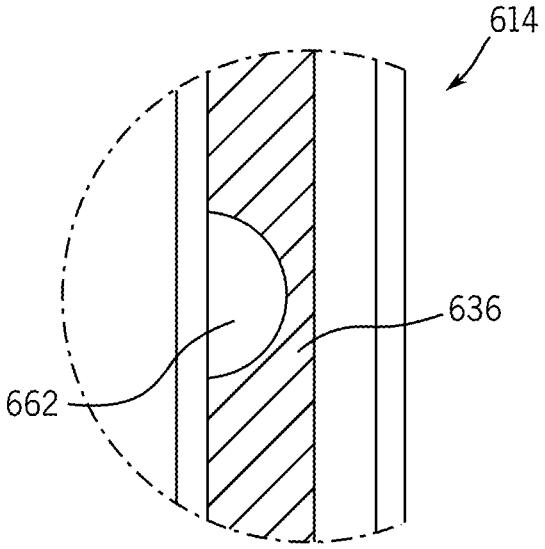

In some implementations, the recess 662 can have a floor 664 and opposing first and second walls 666 and 668. In one implementation, the recess 662 has a depth d of at least 0.40 mm and a width w of at least 0.5 mm. In another implementation, the recess 662 can have a depth d of 0.5 mm and a width w of 1.0 mm, and the lip thickness $t_1$ can be 0.4 mm. The floor 664 and each of the first and second walls define a recess angle $\alpha$. In one implementation, the recess angle $\alpha$ is approximately 90 degrees, such as shown in FIG. 20. In other implementations, such as the recess 662 shown in FIG. 22A, the recess angle $\alpha$ is within the range of 50 to 150 degrees. In other implementations, the recess angle $\alpha$ can be within the range of 70 to 110 degrees. In other implementations, the recess 662 can have a general U-shape, a semi-circular shape (see FIG. 22B), a semi-ovular shape or other irregular shape.

Figure 23:
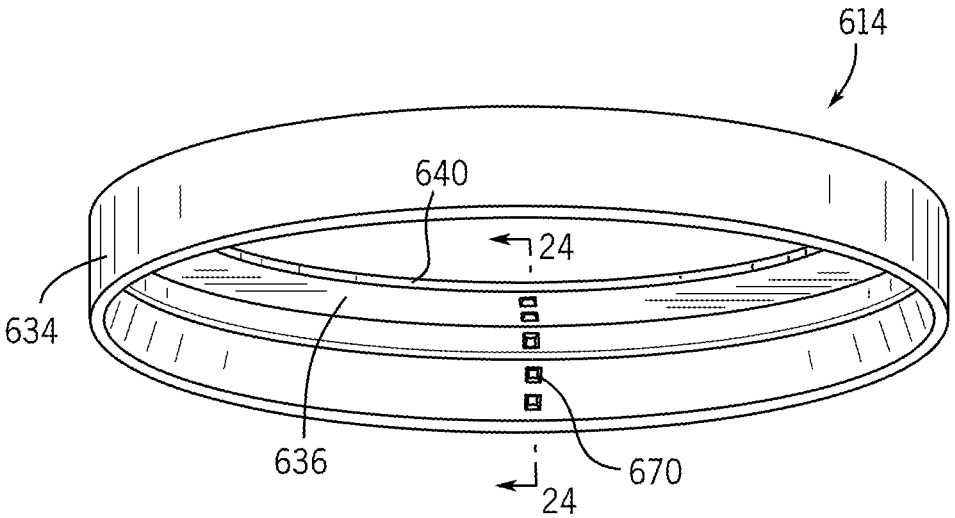
FIG. 23 is a bottom, side perspective view of an overcap in accordance with another implementation of the present invention.
Figure 24:
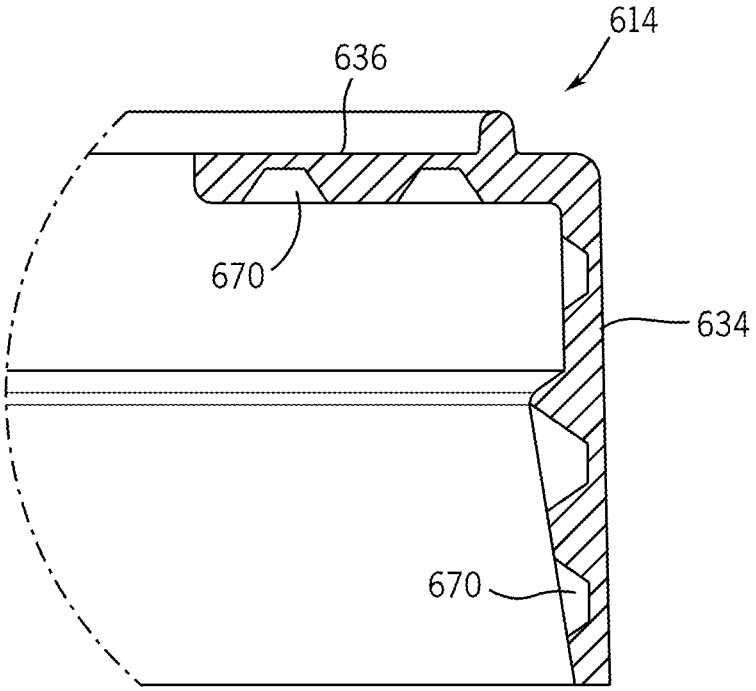
FIG. 24 is an enlarged, cross-sectional view of the taken about line 24-24 of FIG. 23.

Referring to FIGS. 23 and 24, in other implementations, the breakaway region 660 can take the form of a plurality of recesses 670 formed in a collinear manner or a specific pattern to provide for the normal use of the overcap 614 but rupturing of the breakaway region 660 if a tensile load of greater than 7.5 kgf is applied to the overcap 614 under a tensile load test. The recesses 670 can be spaced apart and collinear about the lip 636 and/or about the peripheral rim 634.

Figure 25:
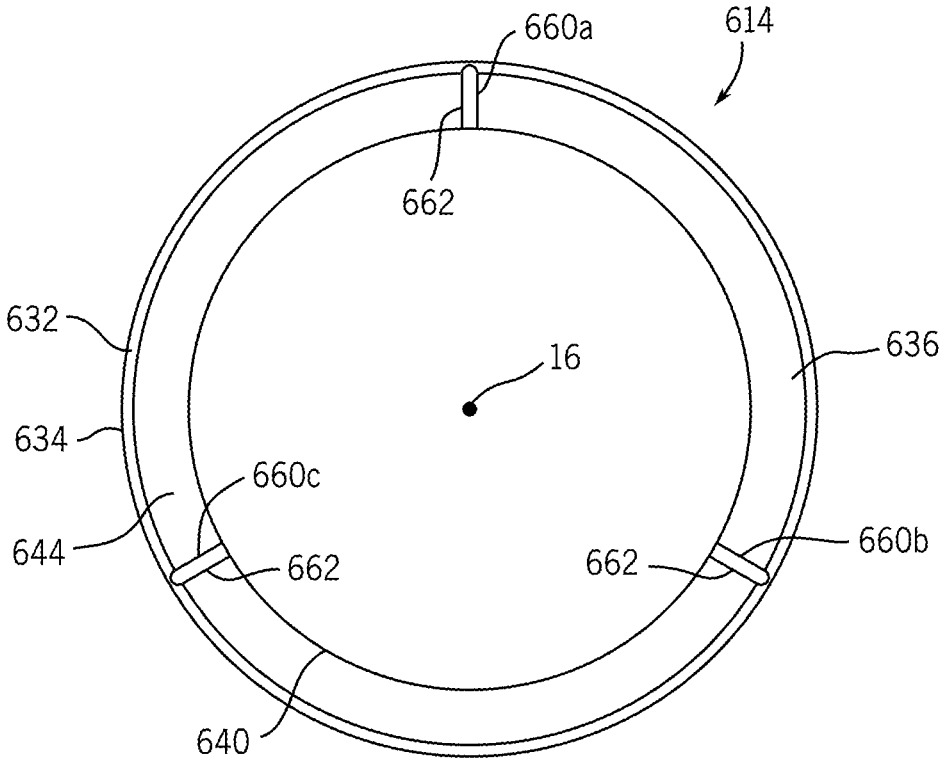
FIG. 25 is a bottom view of an overcap in accordance with another implementation of the present invention.
Figure 26A:
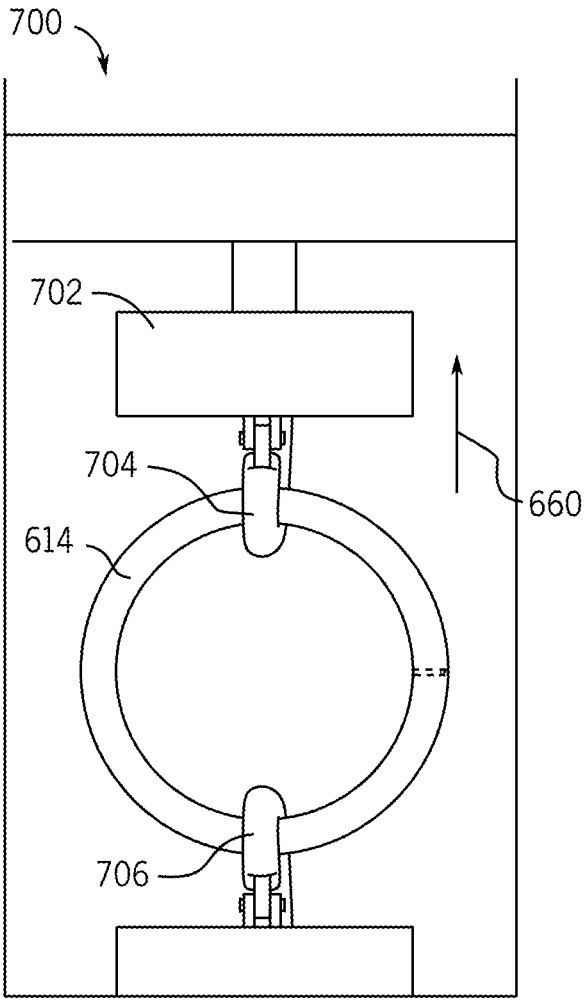
FIGS. 26A and 26B illustrate an overcap tension test where an overcap is positioned between two carabiners before and after rupturing under a tensile load.
Figure 26B:
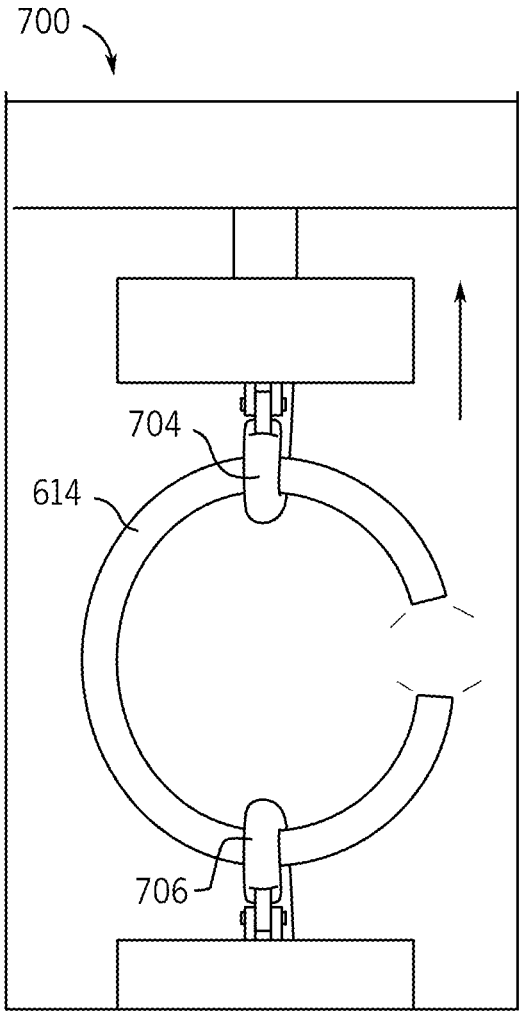

Referring to FIG. 25, in other implementations, the at least one breakaway region 660 can be two breakaway regions, 660*a* and 660*b*, or three breakaway regions 660*a*, 660*b* and 660*c*. As shown in FIG. 25, the three breakaway regions 660*a*, 660*b* and 660*c* can be radially extending recesses 662 that are radially spaced apart from each other about the overcap 614. For example, the three breakaway regions 660*a*, 660*b* and 660*c* can be radially spaced apart by approximately 120 degrees from each other. In other implementations, other the breakaway regions 660 can be spaced apart by other angular amounts.

Table 1 below illustrates the results of an overcap tensile load test performed on two sets of overcaps. Four overcap test specimens of overcaps 14 formed in accordance with the implementation of FIGS. 1-3 without a breakaway region (Specimen numbers 1, 3, 5 and 7) were tested along with four overcap test specimens of overcaps 614 formed in accordance with the implementation of FIGS. 16-19 (Specimen numbers 2, 4, 6 and 8) using a universal test machine 700, which can be an Instron® universal test machine, Model 5581 including a load cell 702. Each of the 8 overcap specimens were positioned between two caribiners 704 and 706. For specimens nos. 2, 4, 6 and 8, the breakaway region 660 of the overcap 614 was positioned at a 3 o'clock position. The caribiners 704 and 706 were then drawn apart at a rate of 50 mm/min and the force value at failure was recorded in kilograms force (kgf). The results, shown below in Table 1, illustrate that the overcaps 614 configured in accordance with the implementation of FIGS. 16-19 failed at a force value of less than 7.5 kgf, while the overcaps 14 configured in accordance with the implementation of FIGS. 1-3 failed at a force value of over 27 kgf. Accordingly, the amount of force required to rupture the overcap 614 (of the implementation of FIGS. 16-19) was 70 percent less than the force required to rupture the overcap 14. The results further illustrate that the overcaps 614 of specimens 2, 6 and 8 configured in accordance with the implementation of FIGS. 16-19 failed at a force value of less than 5.0 kgf.

TABLE 1

| Specimen No. | Force at Break (kgf) |
|---|---|
| 1 | 27.43 |
| 2 | 3.60 |
| 3 | 27.24 |
| 4 | 7.37 |
| 5 | 29.10 |
| 6 | 4.36 |
| 7 | 27.05 |
| 8 | 3.97 |

The significant reduction in the amount of force required to rupture the breakaway region 660 of the overcap 614 is less than 7.5 kgf, and the amount of force required to rupture specimens 2, 4 and 8 was less than 4.5 kgf. Accordingly, the overcaps 614 are configured to easily rupture in the event that they are positioned over a nose, beak, mouth or snout of an animal.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A tennis ball container storing at least one tennis ball, each of the at least one tennis balls having a maximum cross-sectional area and a diameter, the container comprising:

a cylindrical body extending along a longitudinal axis and having a first closed end and a second open end opposite the first closed end;

a removable seal enclosing the second open end and including a pull tab;

an annular overcap removably attached to the second open end of the cylindrical body, the annular overcap including a peripheral rim for engaging an outer surface of the container at the second open end, and a lip projecting from the peripheral rim toward the longitudinal axis, the lip extending over a portion of the second open end, the lip extending over a portion of the removable seal and over a portion of the pull tab, the lip defining a first opening, the lip configured to inhibit the at least one tennis ball from passing through the first opening, the annular overcap defining at least one breakaway region for facilitating breaking of the annular overcap when separated from the second end of the cylindrical body, the annular overcap being formed from a resilient plastic and the at least one breakaway region being configured such that (1) the annular overcap is configured to be repeatedly removed from and reattached to the second end of the cylindrical body with the at least one breakaway region and the annular overcap remaining intact and (2) the annular overcap completely ruptures in response to at least one breakaway region being broken.

2. The tennis ball container of claim 1, wherein, when the removable seal is attached to the second open end of the cylindrical body, the tennis ball container is pressurized.

3. The tennis ball container of claim 1, wherein the first opening of the body is sized to be smaller than one or both of the diameter of the tennis ball and the maximum cross-sectional area of the tennis ball.

4. The tennis ball container of claim 1, wherein the lip uniformly projects from the peripheral rim.

5. The tennis ball container of claim 1, wherein the tennis ball container is positionable between first, second and third configurations, wherein, in the first configuration, the removable seal and the overcap are secured to the second open end of the cylindrical body, wherein, in the second configuration, both the removable seal and the overcap are removed from second open end of the cylindrical body such that the at least one tennis ball can exit the tennis ball container through the second open end, and wherein, in the third configuration, only the overcap is attached to the second open end of the tennis ball container such that the at least one tennis ball within the tennis ball container is inhibited from exiting the second open end of the cylindrical body.

6. The tennis ball container of claim 1, wherein the at least one breakaway region is a recess formed in the lip.

7. The tennis ball container of claim 6, wherein the recess further extends across the lip and along to the peripheral rim.

8. The tennis ball container of claim 6, wherein the lip has a thickness, and wherein the recess has a depth within the range of 30 to 70 percent of the thickness of the lip such that the annular overcap can be repeatedly mounted to and removed from the second end of the cylindrical body while remaining intact and un-ruptured.

9. The tennis ball container of claim 8, wherein the depth of the recess is within the range of 45 to 55 percent of the thickness of the lip such that the annular overcap can be repeatedly mounted to and removed from the second end of the cylindrical body while remaining intact and un-ruptured.

10. The tennis ball container of claim 1, wherein the at least one breakaway region is a recess formed in the lip and the peripheral rim, and wherein the peripheral rim has a thickness, and wherein the recess has a depth within the range of 30 to 70 percent of the thickness of the peripheral rim such that the annular overcap can be repeatedly mounted to and removed from the second end of the cylindrical body while remaining intact and un-ruptured.

11. The tennis ball container of claim 10, wherein recess has a depth of at least 0.4 mm such that the annular overcap can be repeatedly mounted to and removed from the second end of the cylindrical body while remaining intact and un-ruptured.

12. The tennis ball container of claim 1, wherein the at least one breakaway region is two breakaway regions radially spaced about the annular overcap.

13. The tennis ball container of claim 1, wherein the at least one breakaway region is at least three breakaway regions radially spaced about the annular overcap.

14. The tennis ball container of claim 1, wherein the at least one breakaway region includes at least two collinear recesses radially extending along the annular overcap.

15. The tennis container of claim 6, wherein the recess defined by the lip further includes a floor and a pair of opposing side walls.

16. The tennis container of claim 15, wherein the recess has a depth of 0.5 mm and a width of 1.0 mm such that the annular overcap can be repeatedly mounted to and removed from the second end of the cylindrical body while remaining intact and un-ruptured.

17. The tennis container of claim 15 wherein the floor and one of the pair of opposing side walls define an angle, and wherein the angle is within the range of 50 degrees to 150 degrees such that the annular overcap can be repeatedly mounted to and removed from the second end of the cylindrical body while remaining intact and un-ruptured.

18. The tennis container of claim 15 wherein the floor and one of the pair of opposing side walls define an angle, and wherein the angle is within the range of 70 degrees to 110 degrees such that the annular overcap can be repeatedly mounted to and removed from the second end of the cylindrical body while remaining intact and un-ruptured.

19. The tennis container of claim 1, wherein when the annular overcap is tested under a tensile load test, the annular overcap breaks at the at least one breakaway region when the at least one breakaway region is subjected to a tensile load of at least 7.5 kgf such that the annular overcap can be repeatedly mounted to and removed from the second end of the cylindrical body while remaining intact and un-ruptured.

20. The tennis container of claim 1, wherein when the annular overcap is tested under a tensile load test, the annular overcap breaks at the at least one breakaway region when the at least one breakaway region is subjected to a tensile load of at least 4.5 kgf such that the annular overcap can be repeatedly mounted to and removed from the second end of the cylindrical body while remaining intact and un-ruptured.

* * * * *